US006787279B2

(12) United States Patent
Livengood et al.

(10) Patent No.: US 6,787,279 B2
(45) Date of Patent: Sep. 7, 2004

(54) RANDOM COPOLYMERS USED AS COMPATIBILIZERS IN TONER COMPOSITIONS

(75) Inventors: Bryan Patrick Livengood, Longmont, CO (US); George P. Marshall, Boulder, CO (US); John Melvin Olson, Boulder, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/885,311

(22) Filed: Jun. 20, 2001

(65) Prior Publication Data

US 2002/0197550 A1 Dec. 26, 2002

(51) Int. Cl.[7] ..... G03G 9/087

(52) U.S. Cl. ..... 430/108.4; 430/108.8; 430/109.3

(58) Field of Search ..... 430/108.1, 108.4, 430/108.8, 109.4

(56) References Cited

U.S. PATENT DOCUMENTS

| | | | | | |
|---|---|---|---|---|---|
| 4,027,048 | A | * | 5/1977 | Crystal | 430/108.1 |
| 4,876,169 | A | | 10/1989 | Gruber et al. | 430/110 |
| 5,059,505 | A | | 10/1991 | Kashihara et al. | 430/111 |
| 5,202,215 | A | | 4/1993 | Kanakura et al. | 430/111 |
| 5,229,242 | A | | 7/1993 | Mahabady et al. | 430/106 |
| 5,310,616 | A | | 5/1994 | Akamatsu | 430/110 |
| 5,324,611 | A | | 6/1994 | Fuller et al. | 430/106 |
| 5,344,737 | A | | 9/1994 | Berkes et al. | 430/110 |
| 5,364,724 | A | | 11/1994 | Mahabadi et al. | 430/110 |
| 5,368,970 | A | | 11/1994 | Grushkin | 430/110 |
| 5,482,812 | A | | 1/1996 | Hopper et al. | 430/137 |
| 5,486,445 | A | | 1/1996 | Van Dusen et al. | 430/110 |
| 5,506,083 | A | | 4/1996 | Nash et al. | 430/106 |
| 5,510,220 | A | | 4/1996 | Nash et al. | 430/110 |
| 5,516,612 | A | | 5/1996 | Vianco et al. | 430/106 |
| 5,516,614 | A | | 5/1996 | Nash et al. | 430/106 |
| 5,955,235 | A | * | 9/1999 | Lin | 430/108.1 |
| 5,972,553 | A | * | 10/1999 | Katada et al. | 430/108.8 |
| 5,985,501 | A | * | 11/1999 | Sato et al. | 430/106 |

FOREIGN PATENT DOCUMENTS

WO WO-00/18807 A1 * 4/2000

* cited by examiner

*Primary Examiner*—Christopher RoDee
(74) *Attorney, Agent, or Firm*—John A. Brady

(57) ABSTRACT

The present invention is a random copolymer and its use to compatibilize the components of mixtures of immiscible polymeric materials used in the preparation of toner formulations.

1 Claim, 9 Drawing Sheets

*FIG. 4a*

| Example Number | Base Resin |
|---|---|
| 1 | 100 parts (weight) Styrene/Acrylic random copolymer 80/20 |
| 2 | Same as example 1 |
| 3 | Same as example 1 |
| 4 | Same as example 1 |
| 5 | Same as example 1 |

FIG. 4b

| Wax Additive | Random Copolymer (compatabilizer) |
|---|---|
| 4 parts (weight) polyethylene wax | 2 parts (weight) 81/19 wt. % ethylene/n-butyl acrylate random copolymer (high molecular weight) |
| Same as example 1 | 3 parts (weight) 81/19 wt. % ethylene/n-butyl acrylate random copolymer (low molecular weight) |
| 4 parts polypropylene wax | 2.5 parts (weight) 81/19 wt. % ethylene/n-butyl acrylate ranaom copolymer (high molecular weight) |
| Same as example 1 | 2.5 parts (weight) 60/20/20 weight ratio ethylene/ethyl acrylate-graft-polystyrene copolymer (high molecular weight) |
| 3 parts (weight) polyethylene wax | 1.5 parts (weight) 81/19 wt. % ethylene/n-butyl acrylate random copolymer (high molecular weight) |

*FIG. 4c*

| Other Additives | Maximun Wax Domain Size (microns) |
|---|---|
| Carbon black or magnetite, proprietary materials of charge control and control of other toner properties. | 3.5 |
| Same as example 1 | 5.5 |
| Same as example 1 | 4.5 |
| Same as example 1 | 2.3 |
| Same as example 1 | 2.5 |

FIG. 5a

| Example Number | Base Resin |
|---|---|
| 6 | 100 parts (weight) Styrene/Acrylic random copolymer 80/20 |
| 7 | 100 parts (weight) Styrene/Acrylic random copolymer 80/20 |
| 8 | 100 parts (weight) Styrene/Acrylic random copolymer 80/20 |
| 9 | 100 parts (weight) Styrene/Acrylic random copolymer 80/20 |

FIG. 5b

| Wax Additive | Random Copolymer (compatabilizer) |
|---|---|
| 4 parts (weight) polyethylene wax | 3 parts (weight) 30/70 wt. % ethylene/n-butyl acrylate random copolymer (high molecular weight) |
| 2.5 parts (weight) polyethylene wax | 1.0 parts (weight) 60/20/20 wt. % ethylene/ethyl acrylate/ styrene random copolymer (high molecular weight) |
| 4 parts (weight) polyethylene wax | 3 parts (weight) 55/15/30 wt. % ethylene/glycidyl methacrylate/styrene random copolymer (high molecular weight) |
| 4 parts (weight) polyethylene wax | 3 parts (weight) 55/15/30 wt. % ethylene/glycidyl methacrylate/styrene random copolymer (high molecular weight) |

FIG. 5c

| Other Additives | Performance as a toner resin |
|---|---|
| Carbon black or magnetite, proprietary materials of charge control and control of other toner properties | satisfactory |
| Carbon black or magnetite, proprietary materials of charge control and control of other toner properties | satisfactory |
| Carbon black or magnetite, proprietary materials of charge control and control of other toner properties | satisfactory |
| Carbon black or magnetite, proprietary materials of charge control and control of other toner properties | satisfactory |

RANDOM COPOLYMERS USED AS COMPATIBILIZERS IN TONER COMPOSITIONS

FIELD OF INVENTION

The present invention relates to developers used to visualize latent images in electrophotographic systems such as electrophotographic copiers, printers, and like devices.

BACKGROUND OF THE INVENTION

Electrophotographic toners, or when blended with a carrier, electrophotographic developers, are used to produce visible images from a latent static electric image formed within an electrophotographic device. The basic steps involved in electrophotography and the equipment by which those steps are carried out is well known in the art. In general the electrophotographic process involves the formation of a latent electrostatic image, usually by depleting the charge on an insulating photoconductive plate or drum (photoconductive element) which has received a uniform static charge. Charge depletion of the photoconductive element is typically accomplished through exposure of the charged photoconductive element to an image (pattern of light and dark areas), the areas of the photoconductive element thereby receiving illumination being discharged in proportion to the light received. The image thus formed is visualized by treating it with colored material (a "toner" or "developer") which has been triboelectrically charged so that it is attracted to and adheres to the charged areas of the latent image through electrostatic interaction. This "developed" image is thereafter transferred to a support material, such as paper or acetate. This image is then affixed to the support by physical or chemical means, such as by applying heat or pressure (or both) to the developed image sufficient to fuse it to the support.

Representative examples of the current art of electrophotography are to be found disclosed in U.S. Pat. No. 5,437,949 to Kanbayashi et. al., U.S. Pat. No. 4,298,672 to Lu, U.S. Pat. No. 4,338,390 to Lu, U.S. Pat. No. 4,560,635 to Hoffend, et. al., U.S. Pat. No. 4,883,735 to Watanabe et al., U.S. Pat. No. 3,900,588 to Fisher, U.S. Pat. No. 3,720,617 to Arun et. al., and U.S. Pat. No. 3,590,00 to Frank et. al. as representative examples of the art.

In the electrophotographic art, a developer is any composition employed to visualize a latent image. The term toner is applied to a finely divided pigmented powder capable of receiving an electrostatic charge and used to develop the latent image in an electrophotographic process. One skilled in the art will appreciate from the following disclosure that the present invention, while directed to toner compositions, is equally well employed in dry powder compositions directed at developing latent electrostatic images wherein such "developer" compositions would also fit within the definition of a toner composition as it is used in this disclosure.

The fundamental toner composition consists of a thermoplastic primary resin (although primary resin materials other than thermoplastics are known in the art) and a coloring agent. The primary resin serves as a medium into which the other components are suspended or dissolved, as well as serving to facilitate fusing of the developed image to the support. The coloring agent (which includes black) is incorporated to form an easily visualized image.

The requirements of the electrophotographic process usually require that the toner composition also incorporate additional materials (beside the primary resin and the coloring agent) which facilitate its manufacturability and enhance the imaging properties and performance of the finished toner composition.

One of the primary requirements of a toner is that the material must be capable of developing and holding a triboelectric charge. In use, the toner particles acquire a triboelectric charge to enable them to adhere to the latent electrostatic image. The charge control agent is added to impart the charge retention and mass/charge ratio characteristics desired for a particular toner in a particular application. For this reason, in addition to the primary resin and coloring agent, a typical toner material also contains a charge control agent. Numerous charge control agents are known in the art, the disclosures of U.S. Pat. No. 5,318,883 to Yamanaka et. al; U.S. Pat. No. 4,883,735 to Watanabe et. al.; U.S. Pat. No. 4,560,635 to Hoffend et. al.; and U.S. Pat. No. 4,298,672 to Lu disclose examples of such agents. Charge control agents are well known in the prior art. Additional examples of some specific charge control agents incorporated into toner compositions are disclosed in U.S. Pat. No. 4,883,735 to Watanabe et. al., U.S. Pat. No. 4,560,635 to Hoffend, et. al., and U.S. Pat. No. 4,298,672 to Lu, although this is by no means an exhaustive list, many other materials are well known and used by those skilled in the art of toner manufacture.

Examples of toner compositions having these basic components are, by way of example, recited in the all of the patents cited above, such compositions also appearing frequently in the literature of the art of toner compositions. Examples of common primary resins chosen for toner compositions are polymers based on styrenes, epoxides, esters, acrylates, and urethanes, although the use of numerous other thermoplastics, alone and in combinations, are well known and practiced in the art.

Coloring agents may be any colorant such as is well known in the industry, examples of which are disclosed in the above-cited prior art and elsewhere in the literature. The most common colorants being carbon black and magnetite. Colorant may be black, or any color. In particular, colored materials having cyan, magenta, or yellow hue are employed to reproduce "full color" images, and such use is well known to one skilled in the art. Additional materials contemplated as colorants include such materials as polymer grafted carbon blacks, such as those grafted with hydrophobic styrene acrylic copolymers, commercially available from Rit-Chem Co., Inc. of Pleasantville, N.Y., and polymeric dyes disclosed in a paper entitled "In Situ Generation of Polymeric Dyes by Thermal Activation", presented by Kolb, et. al. in May, 1994 in Rochester, N.Y., at the 1994 annual conference of The Society for Imaging Science and Technology.

The toner composition is typically manufactured as a melt-blended pellet, the pellets being derived from the blend by any method such as is well known in the chemical processing industry. Examples of such processes (and the related processing equipment) are extrusion and spray drying. Pellet formation is not limited to these specific techniques, as it will be apparent to one skilled in the processing industry that there are many other methods and adaptations of these basic process that are equally suitable to pellet formation from this material. Typically, toner compositions may be blended in (but are not limited to) Banbury mixers, rubber mills, conical mixers, band mixers, blenders, and extruder hoppers. Once rendered into pellet form, the pellets are milled in any equipment such as is well know to produce particles of suitable size for use in electrophotographic equipment. The milled material is then typically classified. Any number of mechanical means such as are well known in the industry to produce a narrow particle size range powder may be employed. Typically, most of the fines (particles significantly smaller in diameter than the desired average particle diameter, typically on the order of 5 microns) separated out of the raw milled material are recycled back into the pelletizing process to minimize materials toner raw materials waste.

Conventional dry toner material may be used in a wide variety of eletrophotographic imaging systems such as are well known in the art. In general, dry toner is classified depending upon the equipment in which it is employed. The various systems in which dry toner is used are distinguished by the mechanism(s) by which the toner is applied to the latent image (cascade; powder cloud; magnetic brush, magnetic roller, electrostatic roller), the type of imaging system used (negative or positive image), and whether the toner material acquires a triboelectric charge from contact with a surface within the imaging equipment (single component) or via contact with a carrier material which imparts a charge to the toner (dual component systems). These various systems require differences in toner formulation, such as the inclusion of additional materials which can acquire a triboelectric charge, or a magnetic particle. In spite of these differences in composition, the behavior of all formulations of toner materials within the electrophotographic equipment presents some common problems which are solved or managed through common formulations among all types of toner materials aimed at improving compatibility between the constituents of the toner formulation. These problems can be divided into problems of unsatisfactory imaging behavior and poor materials handling characteristics. Often they are related as symptom and cause, that is to say that a poor image is caused by the toner fouling a surface within the electrophotographic device.

One of the common problems seen in toner compositions is cohesive failure of the primary resin during the fusing step of the electrophotographic process in which the developed image is affixed to the support. This failure results in some of the toner composition being transferred to a working surface in the electrophotographic equipment, the transferred material then being transferred to a later processed image. This problem is sometimes termed "hot offset". The problem is generally addressed in dry toner formulations by including a "release agent" in the toner composition. Such formulations are said to incorporate an internal release agent, as opposed to solutions in which a separate release agent is applied to the working surfaces in the electrophotographic equipment. U.S. Pat. No. 5,344,737 to Berkes et. al., U.S. Pat. No. 5,324,611 to Fuller et. al., and U.S. Pat. No. 4,876,169 to Gruber et. al., all contain examples of the types of materials typically employed as release agents. Generally these materials are waxes or parafin materials. Inclusion of these materials in toner compositions gives rise to several difficulties arising from the fact that the release agent is incompatible with the primary resin of the toner. The incompatibility between the primary resin and internal release agent therefore requires a delicate balance to be achieved between a sufficient quantity of release agent to suppress hot offset without incorporating an amount so large that processing and reproduction problems arise. Often, less than a optimal amount of internal release agent must be employed in order to produce a toner composition that does not exhibit the negative aspects associated with higher levels of internal release agent, resulting in toner formulations which pose limitations on finished toner particle size and useful operating temperature range.

One consequence of the incompatibility is inhomogeneous toner compositions wherein the release agent exists as phase separated bubbles or domains of the release agent dispersed within the primary resin. FIG. 1 illustrates the effect of adding increasing amounts of internal release agent into a typical toner formulation without the addition of a compatibilizer. It can be seen that the growth of internal release agent domain size is linear with weight percent of added toner. Domain size also increases as the free energy of mixing becomes increasingly unfavorable due to the chemical nature of a particular release agent and primary resin. With correspondingly larger domain size comes decreasingly strong interaction of the two phases. As domain size grows the total area of the boundary between the "surface" of the internal release agent domains and the "surface" of the primary resin contacting the internal release agent domains decreases. Additionally, the boundary can become increasingly less diffuse, resulting in a decrease in unit interfacial strength.

One outgrowth of this facet of the incompatibility problem is that the finished toner material is friable along the primary resin/internal release agent boundary. This results in the internal release agent domains "breaking out" of toner particles and concentrating in the fines during the milling and classification steps in the process of preparing toner. This results in increased concentration of internal release agent in the fines over what is desired (or prudent) in the toner composition. The result is that recycle of toner fines is problematic, and far more fines must be removed from the finished toner material before it can be employed in an electrophotographic process than would otherwise be required. This leads to an overall lower material yield with concomitant increased cost of preparing the toner material.

An additional problem arising out of large internal release agent domains is that the minimum size of usable toner particles is restricted to a size significantly larger than the internal release agent domain. When gross particle size approaches two to three times that of the internal release agent domain size, the resultant material is too fragile to withstand the impact experienced in normal toner handling and electrophotographic processing. In such an instance, the toner particles fracture along the internal release agent domain boundaries resulting in an inhomogeneous mixture of toner components.

Very fine particles of internal release agent can fracture out of the toner particles, which can coat internal mechanisms in the electrophotographic equipment, for example the "doctor blades" used in some equipment to provide an even layer of toner on rollers and electrostatic developer roll, and in some cases to charge the toner. Coating of the "doctor blades" and developer roll leads to poor image quality or increased maintenance or both. In addition, the fractured out release agent can form a coating on the milled toner particles. Such a coating interferes with the triboelectric charging of toner particles, leading to additional image problems.

The addition of an internal release agent also places limitations on the conditions under which toner compositions incorporating the internal release agent may be processed. Typically, as exemplified in the disclosure of U.S. Pat. No. 5,368,970 to Grushkin, the blending of the components of a toner composition must be done at minimal temperature to minimize "viscosity incompatibility" between the components, and thus minimize internal release agent domain size. This limits the apparatus in which toners can be prepared, and also limits toner batch sizes, both of which lead to increased cost of toner composition preparation.

One approach to reduction of problems associated with incorporation of internal release agents into toner compositions has been termed "technological compatibilization". "Compatibilization" of polymer blends such as those employed in toner composition is discussed at length in Bonner and Hope "Compatibilization and Reactive Blending," Chapter 3 of *Polymer Blends and Alloys*, edited by M. J. Folkes and P. S. Hope, Blackie A & P, 1993.

When the term "compatibilization" is applied to toner compositions, it is used in the sense that the interface region between incompatible constituents (internal release agent and primary toner resin) is altered to minimize the domain size of the internal release agent "globules" within the toner, with or without a concomitant increase in unit interfacial bonding strength between the phases. An alternative way to conceptualize this approach is that the thermodynamics of the interface has been altered to maximize (or at least increase) the area of contact between the two constituents. Such an increase indicates that the interfacial strength between the two components has been increased. It is known in the art that an indicator of successful compatibilization is the reduction of the domain size of the internal release agent for a given set of processing conditions and component stoichiometries over that observed in a compositions in which compatibilization has not been addressed.

As discussed above, a processing approach to the problem may be taken, e.g. low temperature blending of the components to minimize viscosity incompatibility. This approach is limited in the range of incompatibility that can be overcome. For this reason approaches to altering the interface chemically have been preferred to purely processing solutions.

One such approach to technological compatibilization is the addition of a compatibilizer before or during the mixing/blending process. It is known that block and graft copolymers can serve to compatibilize the constituents of toner compositions. To be effective, the compatibilizing block or graft copolymer must possess segments with chemical structures or solubility parameters similar to or the same as those of the polymers being blended, and a sufficient amount of the compatibilizing polymer must be located at the interface of the polymer phases. Such copolymer compatibilizers are disclosed in numerous patents assigned to Xerox Corporation, e.g. U.S. Pat. No. 5,229,242. A method of promoting the presence of a compatibilizing block copolymer at the interfacial region is to use reactive mixing techniques, whereby the compatibilizing copolymer forms at the interface. In such cases, polymer molecules of one phase contain functional groups which chemically interact with molecules of a polymer in an adjacent phase, so that a compatibilizer forms in the interfacial regions where it is needed. Other approaches have been disclosed in the prior art which follows.

U.S. Pat. No. 5,310,616 to Akamatsu discloses toner compositions for electrostatic copiers containing siloxane resins with difunctional and trifunctional siloxane units as charge regulating agents. The siloxane units of the resins can contain aminofunctional hydrocarbon radicals or haloalkyl radicals.

U.S. Pat. No. 4,876,169 to Gruber et al. discloses toner compositions containing particles of polyesters, the surfaces of the particles having been derivitized by grafting siloxane block segments onto pendant groups residing there. The siloxane segments functioned as a release agent, obviating the necessity of adding a release agent to the toner composition.

U.S. Pat. No. 5,202,215 to Kanakura et al. discloses toners which are prepared by dispersion-polymerizing a vinyl monomer in the presence of a dispersion polymerization stabilizer, a polymerization initiator and silicone-containing organic resin microparticles. The microparticles are formed by grafting an organic siloxane moiety onto a polymethacrylate particle. The particles themselves are formed from copolymerization of methacrylate and siloxane monomers. The dispersion medium is chosen such that it dissolves the vinyl monomer, the polymerization stabilizer and the initiator but not the silicone-containing organic resin microparticles or the resulting toner particles. Toners made with base resins of styrene/methacrylate copolymers and incorporating the derivatized microparticles can be formulated without the addition of an internal release agent. Amino-silicone compounds can also be used in microparticle formulation.

U.S. Pat. No. 5,059,505 to Kashihara et al. discloses spherical resin particles for electrophotographic toners formed in dispersion polymerization reactions. The particles incorporate the chemical functionality of all the components of a standard toner formulation by copolymerization of moities containing such functionality under conditions which produce 3 micron particles of the copolymer. Toner prepared by this process can employ monomers such as styrene and maleic acid in the copolymerization reaction.

U.S. Pat. No. 5,364,724 to Mahabadi et al. discloses toner compositions comprised of resin particles, pigment particles, wax component particles, and a compatibilizer comprised of block or graft copolymers. This patent is a continuation of U.S. Pat. No. 5,229,242.

U.S. Pat. No. 5,486,445 to Van Dusen et al. discloses toner compositions comprised of resin particles, pigment particles, wax component particles, and a compatibilizer comprised of a diblock polymer of hydrogenated polystyrene/polyisoprene or polystyrene/polybutadiene with isoprene/ethylene/isopentene/vinylbutene/vinyl-2-methylbutene groups or isoprene/ethylene/butene/and vinylbutene groups, with the wax and diblock polymer forming domains of average particle diameter of 0.1 to 2 microns. In column 4, the patent discusses U.S. Pat. No. 5,229,242.

U.S. Pat. No. 5,516,612 to Vianco et al. discloses developer particles comprised of a toner comprised of at least one resin, a wax release agent, a pigment, charge additive, a surfactant, a thermoplastic rubber compound as an agent to regulate charge retention, and a carrier. In this disclosure, the rubber compound also acts to compatibilizing the toner composition.

U.S. Pat. No. 5,510,220 to Nash et al. discloses developer compositions which are formulated to permit the omission of wax release agents from the formulation. The process disclosed produces toner particles which are comprised of crosslinked poyester resin, pigment particles, and other typical toner components rendered as an extruded pellet. These pellets are milled and the resultant powder is classified, the particle cut of desired size being then coated with metal salts, oxides, and surfactants to impart the desired properties to the finished toner.

U.S. Pat. No. 5,368,970 discloses toner compositions comprised of the reaction products of wax particles containing hydroxyl or acid groups, and an alkylene-glycidyl methacrylate polymer, pigment particles and a wax component. Ethylene-glycidyl methacrylate copolymers are used as reactive compatibilizers to improve the dispersion of wax in the toner resin.

U.S. Pat. No. 5,506,083 to Nash et al. discloses developer and toner compositions similar to those of U.S. Pat. No. 5,368,970, using the same compatibilizers.

U.S. Pat. No. 5,496,888 to Nishida et al. discloses resin compositions for toners, comprising styrene/acrylic polymers with polyester polymers dispersed therein, the mixture being compatabilized with the aid of block and graft copolymers.

U.S. Pat. No. 5,482,812 to Hopper et al. discloses processes for preparing toner compositions or particles containing wax dispersions by coprecipitation of toner particles from aqueous dispersions of the toner components. The toner component aqueous dispersions are stabilized prior to toner particle precipitation with anionic and cationic surfactants. Charge neutralization is thought to play a role in particle formation in this process. The process extends the range of equipment in which toner processing can be carried out by permitting formation of toner particles at temperatures below those required to produce toners from neat blending of the toner components.

U.S. Pat. No. 5,344,737 to Berkes et al. discloses toner compositions containing resin, pigment, wax and a polymeric component to disperse the wax. The dispersant is described as an ethoxylated polyol which is in the form of a diblock copolymer. These materials are thought to function similarly to nonionic surfactants. These are added to conventional toner components which are blended in conventional toner processing equipment using typical toner processing steps such as melt mixing, extruding, milling, and classifying.

U.S. Pat. No. 5,324,611 to Fuller et al. discloses toner compositions incorporating hydrogenated polystyrene/polybutadiene copolymers as base resins with pigment and charge control agents added to formulate toner resins. Hydrogenation of the base resin is said to obviate or reduce the need for release agents in the xerography process. Also disclosed was the improvement via hydrogenation of finished toner particles comprised of the above listed components, and the improvement in release characteristics of a toner of similar composition which also incorporated a hydrogenated polyol.

U.S. Pat. No. 5,516,614 to Nash et al. discloses toner compositions ultimately directed at the production of insulating developer compositions. The disclosed compositions are comprised of resin particles, pigment particles, wax component particles, and other typical additives. The components are compatabilized by the incorporation of moieties such as ethylene-glycidyl methacrylate copolymer grafted onto hydroxyl functionality occurring within the base resin polymer used in the toner. The compositions are similar to those of U.S. Pat. No. 5,368,970 discussed above. Also disclosed are surface derivatized carrier particles based upon conventional materials traditionally employed as carriers in the art of toner formulation.

It is apparent that although a variety of methods have been devised to compatibilize internal release agents and other polymeric additives with the primary resins of toner compositions, a need remains for more effective and/or economical compatibilizers for these internal release agents. It is known in the art that block and graft copolymers are effective compatibilizers of polymer blends. It is also well known that where one phase is a dominant material in a blend, assymetric block compatibilizer copolymers are more effective at compatibilization of the blend than copolymers with equal length blocks. It is also known in the art that block copolymers are one end of a spectrum of copolymers that ranges from alternating to block copolymers. This is to say that for a copolymer made from A and B monomers, one end of the spectrum is a polymer comprised of strictly alternating A-B-A-B units (an "alternating copolymer"), while the other end is a polymer having one end A—A—A in a single block with the other end B—B—B in a single block (a "block copolymer"). Random copolymers are comprised of segments of A and segments of B monomer occurring along the polymer chain, the segments containing a random number of repeat units with each occurrence.

The present invention takes notice of the fact that block and graft copolymers are expensive, greatly increasing the cost of toner production. At least as expensive as block copolymers, and adding production complexity in addition, is chemical modification of the surface of a finished toner particle by further reaction with a "compatibilizing" polymer, producing a toner particle with a "graft polymer-like" surface.

The present invention is directed at eliminating this expense by employing random copolymers as compatibilizers, which polymers are cheaper to manufacture and more readily available than block and graft copolymers. Additionally, in the case of graft copolymers and derivatized surfaces, the use of random copolymers to compatibilize toner compositions eliminates the additional processing steps required to form such materials.

The prior art suggests that only block and graft copolymers, and surfaces derivitized in chemical reactions that are of the same type as those employed in the formation of graft copolymers are suitable to compatibilize the constituents of blends of incompatible polymers. The present invention has found that random copolymers may be equally well employed. In the formulation of toner materials, the random copolymers used as compatibilizers are made from monomers which produce segments in the copolymer that are individually compatible with either the primary resin of the toner composition (or some structural unit contained within the primary resin) or the internal release agent employed in a given toner formulation (or some structural unit present in the intral release agent). The production of a random copolymer requires little in the way of control or processing (compared with the production of graft and block copolymers) to produce material having the ability to function as a compatibilizer, and thus may be custom made at low cost. Additionally, many suitable random copolymers are commonly available as commodity materials.

There is a large body of literature devoted to understanding compatibilizers for polymer blends. The concepts presented in *Polymeric Compatibilizers, Uses and Benefits in Polymer Blends*, Sudhin Datta and David Lohse, Hanser/Gardner, New York 1996 are illustrative of the current state of knowledge. In general, much of the theoretical understanding of compatibilization is based on a block copolymer compatibilizer in a two-component polymer blend. Two basic concepts arise out of this work. The first concept is that there is a spectrum of behaviors between a "pure alternating" copolymer (that is, in a two component system a monomer moiety A alternates perfectly with a monomer unit B to form an ABAB polymer) and a "pure block" copolymer, that is for a given two component polymer composed of A and B monomers, one end of the chain is solely composed of A and the other end solely composed of B moieties.

In the case where a polymer blend of incompatible materials is made of C polymer which is compatible with the A moieties of an AB copolymer and D polymer which is compatible with the B moieties of an AB copolymer, the prior art suggests that a pure alternating AB copolymer will not compatibilize the CD blend. In this same situation, a "pure block" AB copolymer will act as an effective compatibilizers of the CD blend.

The second concept arising from the prior art is that in a "pure block" copolymer composed of A and B monomers, optimally, the length of the A and B blocks should not be equal. The theory is that the longer blocks need more volume than the shorter blocks. The implication is that, using a block copolymer having a long A block and a short B block for example, when such a copolymer is blended with a polymer in which the A block is miscible, the blend will tend to form curved B domains. In practical terms this implies that to compatibilize a blend comprised of a small amount of B compatibile material blended into a large amount of A compatible material, a block copolymer composed of A and B monomers with a long A block and a short B block will yield an intimate mixture of A compatible and B compatible polymer material. In toner production, however, production of domain sizes below a certain maximum size does not improve the toner formulation, thus less effective compatibilizer can be employed. The present invention notes that a random copolymers having some segments compatible with the base resin and other segments compatible with the internal release agent will tend to concentrate at the interface between the internal release agent and the toner base resin. This has the effect of providing a gradient at the interface of the incompatible materials, increasing the interface strength and reducing the domain size in the finished composition. It has been found that for strong interaction between a random copolymer segment and a material to be compatibilized, an effective compatibilizer can be comprised of as little as 5 weight % of that particular segment, while for less strong interactions as much as 95 weight % must be incorporated. The degree to which a random copolymer has segments resembling a "pure block" or a "pure alternating" copolymer depends upon the conditions under which it was polymerized. The relative reaction rates of monomer self addition versus co-monomer addition (also called reactivity ratio rates) also contribute to the "blocky" or "alternating" character of the random copolymer. For example, the two extremes of relative reaction rates (self addition/co-monomer addition) are zero and infinity. The rate is zero if an A moiety in a polymer chain can only add a B monomer to it. The rate is infinity where an A moiety in a polymer chain adds another A monomer unit at a rate that is infinitely fast compared to A/B addition. In the first case, a pure alternating copolymer will result. In the second case, a pure blocky copolymer of A will form, then add B moieties. Between these two extremes, copolymers containing segments of varying lengths of A and B moieties interspersed will result. This concept can be expressed according to the following relationship:

$$r1=kaa/kab \quad r2=kbbkba$$

where r1 (the "monomer 1 reactivity ratio") is the ratio of the rate of addition of an "A" monomer moiety to a growing "A" polymer chain (kaa, self addition rate) divided by the rate of the addition of a "B" monomer moiety to a growing "A" moiety polymer chain (kab, alternating addition rate) and r2 (the "monomer 2 reactivity ratio") is the ratio of the rate of addition of a "B" monomer moiety to a growing "B" polymer chain (kbb, self addition rate) divided by the rate of the addition of an "A" monomer moiety to a growing "B" moiety polymer chain (kba, alternating addition rate). Cast in these terms, as the rate of "A" moiety self addition becomes fast relative to "B" co-monomer addition (kaa>kab), r1 becomes increasingly large. As the rate of "B" moiety self addition becomes fast relative to "A" co-monomer addition (kbb>kba), r2 becomes increasingly large. For the purposes of producing a co-polymer in one reaction step that is suitable for use as a compatibilizer, it is most desirable to have the situation in which r1 and r2 are both much greater than 1.

To further illustrate this point, and to highlight the role that concentration of the monomer components can play in the formation of random copolymers that can serve as compatibilizers, in the situation where a polymer made from "A" moieties is compatible with a base resin "C" and a polymer made from "B" moieties is compatible with a wax release agent "D", in the case wherein both r1 and r2 are very much greater than 1, a reaction mixture comprised of from 15–85 weight % of moiety "A" will produce a random copolymer that is a good compatibilizer of a mixture of "C" and "D" materials. When either r1 or r2 is greater than 1, regardless of the value of the other, a reaction mixture comprised of from 25–75 weight % "A" moieties will still yield a random copolymer that is a good compatibilizer of a mixture of "C" and "D" materials. In the case where r2 exceeds 1 regardless of the value of r1, suitable random copolymer compatibilizer can be made from a reaction mixture in which monomer "A" is present in amounts between 10–30 weight %, but in the case wherein r1 and r2 are both less than 1 no suitable random copolymer compatibilizer can be made regardless of the composition of the reaction mixture.

Using these principles, random copolymers can be produced in one step reactions which have varying degrees of "block-like" character. Such materials can compatibilize blends of incompatible polymers in a manner similar to the action of a block copolymer used as a compatibilizer.

SUMMARY OF THE INVENTION

One object of the present invention is to provide toner and developer compositions in which the domain size of the incompatible component is minimal and the domains are well dispersed.

Another object of the present invention is to provide a low cost additive to minimize domain sizes of the components in subject toner and developer compositions.

Yet another object of the present invention is to provide a means of compatibilizing the components of toner and developer compositions which reduces the number or processing steps needed to produce toner formulations.

Yet another object of the present invention is to provide a low cost means of compatabilizing toner and developer compositions.

Yet another object of the present invention is to provide a method of overcoming the processing difficulties of producing blends of incompatible polymers mentioned above, thus expanding the potential processing equipment in which developer or toner compositions may be formulated when the constituents are incompatible.

Another aspect is to formulate toner materials containing sufficient wax release agent to prevent hot offset, without incurring the problems usually arising from incorporating high levels of an incompatible internal release agent into the toner resin.

Still another aspect is to include amounts of a compatibilizer copolymer effective to compatibilize the wax release agent with the primary resin of a toner composition, producing an optimum wax domain size.

Still another aspect of the present invention is to provide a method whereby the interfacial strength between the toner composition primary resin and the internal release agent is increased, as reflected in a minimum differential of wax content between the toner particles and the fines separated therefrom.

In still another aspect of the invention, the compatibilizer can be a random copolymer comprising at least one structural unit compatible with at least one repeating structural unit of the primary resin and at least one structural unit compatible with at least one repeating structual unit of the wax release agent used in the toner composition.

Other aspects of this invention will appear from the following description and appended claims, reference being made to the accompanying drawing forming a part of this specification.

In accordance with the present invention, various aspects and advantages are achieved by the employment of a random copolymer compatibilizer in toner compositions to compatibilize the toner primary resin with another polymeric component a wax release agent. Broadly, the improved toners of the invention comprise a primary resin (i.e., toner resin) and at least one additional polymeric component comprising a wax release agent, plus an effective amount of a random copolymer compatibilizer. The compatibilizer copolymer is the free radical polymerization reaction product of monomer components wherein at least one monomer component is incorporated into the resulting random copolymer (compatibilizer) as a structural unit that is compatible with the primary resin and at least one other monomer component is incorporated into the resulting random copolymer (compatibilizer) as a structural unit that is compatible with the wax release agent. The amount of compatibilizer copolymer added to the toner composition is an amount sufficient to at least partially compatibilize the primary resin and the wax release agent. In other words, enough of the random copolymer is added to a toner formulation to achieve "technological compatibility", as discussed above in reference to the Bonner and Hope work.

The amount of compatibilizer added should be sufficient to reduce the wax domain size in the finished toner particles (as measured by Scanning Electron Microscopy) below a level dictated by the size of the milled and classified toner particles. By way of example, a 6–9 micron toner particle would require an average wax domain size of 1–3 microns. Alternatively, a measure of sufficient amounts of compatibilizer would be an amount of compatibilizer which leads to a reduction of the differential in wax content between the toner particles and the fines separated therefrom to less than about 20 weight percent.

Random copolymer combatibilizer will reside typically in the interfacial region between the primary resin of the toner material and the wax release agent domains. Additional components typically found in toner formulations typically will not interact with the compatibilizer, and so should not be adversly effected by the addition of the compatibilizer to the toner formulation. Typical materials which can be present in the toner compositions utilizing random copolymers as compatiblizers, include but are not limited to, colorants, additional modifying resins, surface additives and charge control additives.

In preferred embodiments, the toner compositions comprise at least the primary resin and a wax release agent, plus an amount of a random copolymer compatibilizer that is the reaction product of at least one monomer component that is compatible with at least one segment in the primary resin and at least one monomer component that is compatible with at least one segment found in the wax release agent. Other components may also be present in the composition such as colorants, charge control agents, dispersants, carriers, and the like such as are well known in the art.

A further embodiment of the invention includes processes of preparing the improved toner compositions of the invention, comprising steps of:

a) combining materials comprising a primary resin and a wax release agent, plus amounts of a random copolymer compatibilizer as described above, b) blending the combined materials to yield a dispersion of the minor components having satisfactory physical characteristics as described above, c) extruding the ingredients to form a pellet of the dispersion, and c) grinding the extruded and hardened product to produce finished toner particles.

Normally, most of the fines are then removed from the resulting toner particles by a classification process.

BRIEF DESCRIPTION OF THE DRAWINGS

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

FIGS. 4*a*, 4*b* and 4*c*: TABLE OF EXAMPLES OF TONER FORMULATIONS EMPLOYING RANDOM COPOLYMER COMPATIBILIZERS FIGS. 5*a*, 5*b* and 5*c*: FURTHER EXAMPLES OF TONER FORMULATIONS EMPLOYING RANDOM COPOLYMER COMPATIBILIZERS

DESCRIPTION OF THE PREFERRED EMBODIMENT

Figure 1:
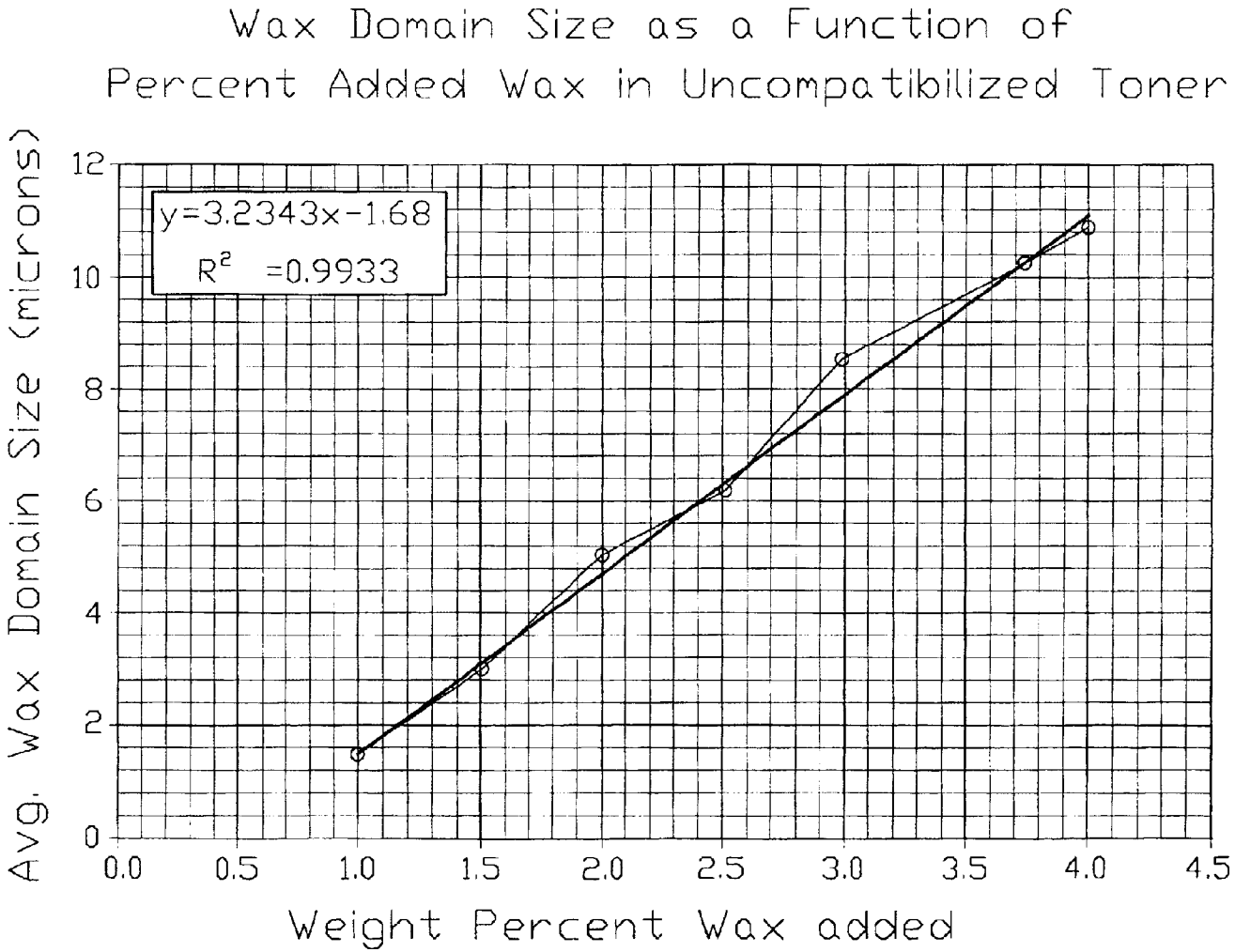
FIG. 1: MAXIMUM SIZE OF WAX RELEASE AGENT DOMAINS IN TONER FORMULATIONS AS A FUNCTION OF INCREASING WEIGHT PERCENT OF WAX RELEASE AGENT ADDED TO THE TONER FORMULATION
Figure 2:
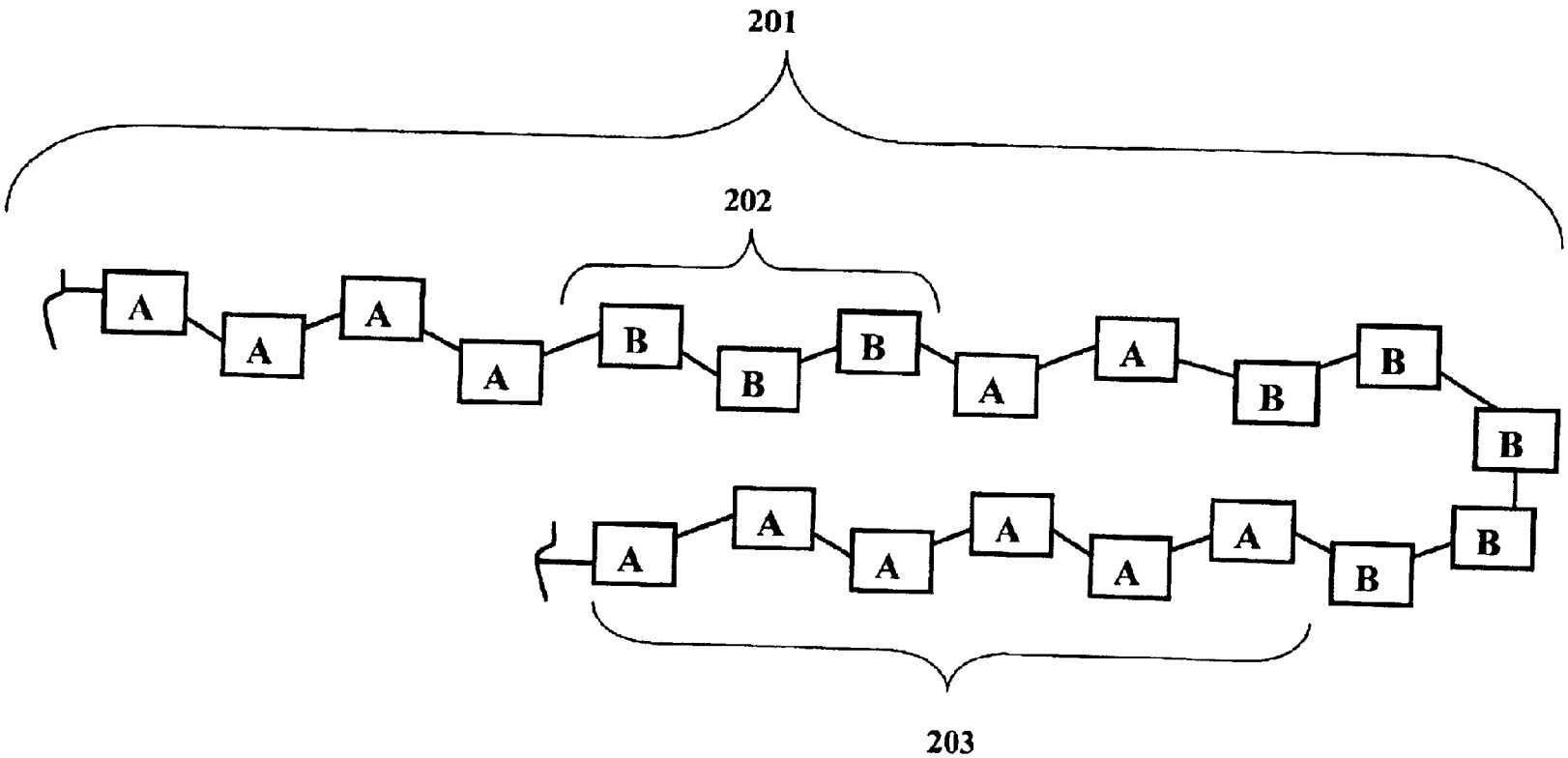
FIG. 2: ONE POSSIBLE CONFIGURATION OF A RANDOM COPOLYMER MADE FROM DIFUNCTIONAL MONOMER UNITS A & B IN A MOLE RATIO OF 3:2

With reference to FIG. 2, compatibilization of an internal release agent may be achieved by incorporating a random copolymer 201, illustrated as being composed of monomer components A and B, into a toner formulation. The monomer component A is chosen such that it is miscible or partially miscible with the base resin, and monomer component B is chosen such that it is at least partially miscible with the internal release agent of a toner composition. The length of the individual A segments such as segment 203, and B segments, such as segment 202 is not strictly important, so long as there is at least a minimum segment length sufficient to interact with each component to be compatibilized in the composition. This may be met by varying the number average molecular weight of the polymer, altering the ratio of the constituent monomers used to form the random copolymer, or altering the reactivity ratio of monomers in the copolymer. These concepts are addressed below.

Figure 3:
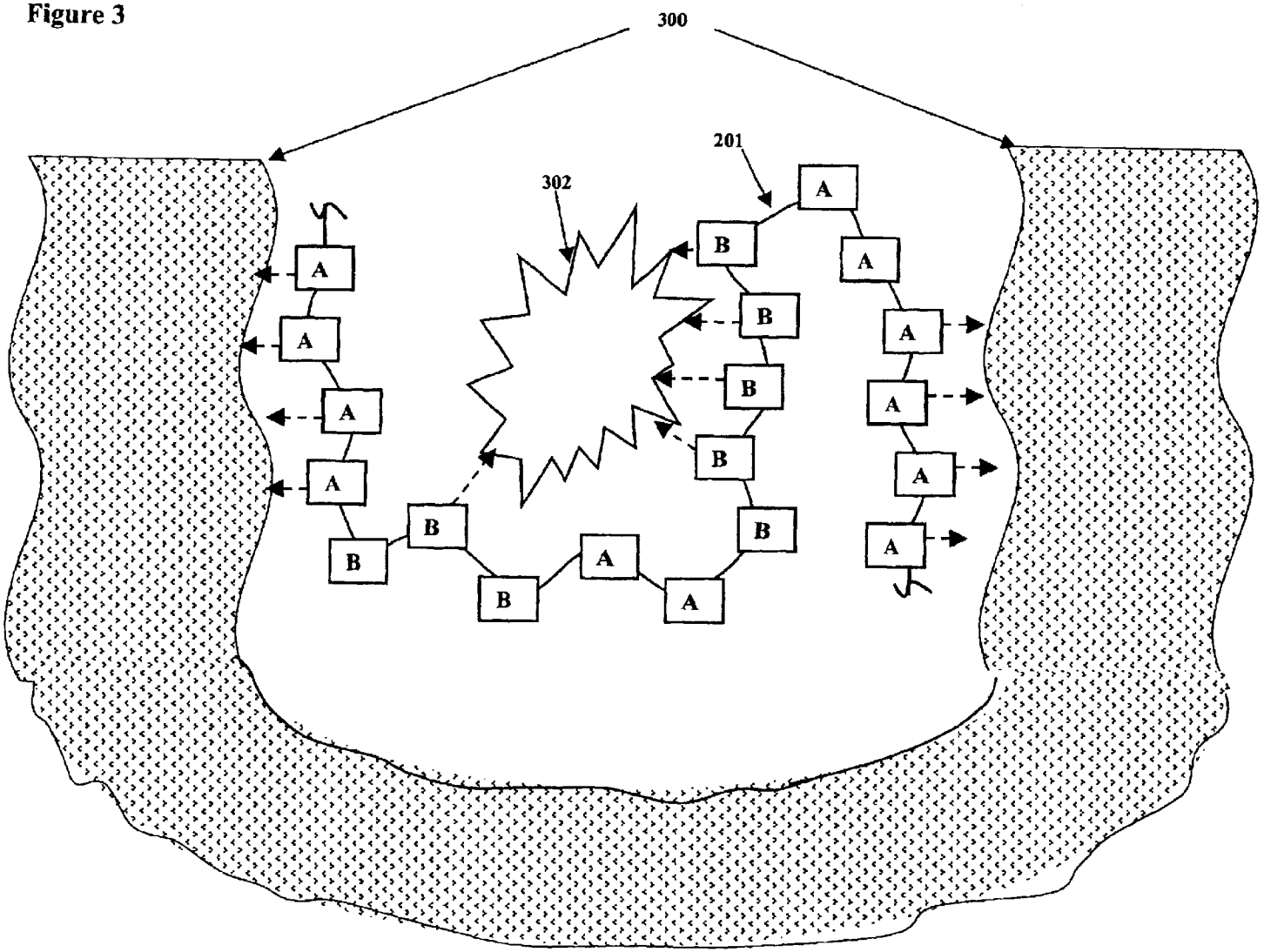
FIG. 3: CONCEPTUAL VIEW OF THE INTERFACE BETWEEN PRIMARY RESIN AND INTERNAL RELEASE AGENT WITH AB RANDOM COPOLYMER RESIDING WITHIN THE INTERFACE

This idea is further illustrated with reference to FIG. 3, wherein a strand of AB random copolymer 201 (having the same sequence of A and B monomer residues as that illustrated for AB random copolymer 201 of FIG. 2) is shown residing at the interface between a region occupied by primary resin domain 300 and internal release agent domain 302 of the toner composition. Interaction of the polymer chain "A" moieties with surface of primary resin domain 300 and "B" moieties with the surface of internal release agent domain 301 is depicted by dotted arrows between the polymer and the surface of the respective domains. It should be emphasized that although FIG. 3 depicts a single polymer chain at the interface, this is done for simplicity of illustration and does not preclude the formation of an interface comprised primarily of many layers of the random copolymer interspaced between the primary polymer and the wax release agent. Additionally, for illustration simplicity, various segments of a polymer chain are shown facing each domain. It is equally likely that an interface region could be formed consisting of many polymer chains each with only a small portion of the polymer segment contacting any phase of the other toner components. In such a construct the various segments of the random copolymer chains would be oriented relative to each other to provide a gradient between the toner composition primary resin and the internal release agent domain.

The random copolymer used as a compatibilizer is selected so that it has segments comprised of at least two different monomer species. One type of segment (repeating structural unit) in the random copolymer being compatible with the primary resin from which a given toner composition is made, while the other type of segment (repeating structural unit) present is compatible with the wax release agent incorporated into the toner composition. The size of the individual segments lying within a polymer chain is not critical, so long as the chain is sufficiently long enough to permit the statistical formation of segments of suitable length to interact with the various domains formed when the random polymer, the toner composition primary resin, and the internal release agent are blended. Additionally, it should be emphasized that the nature of the random copolymer is such that it will concentrate within the interface region between the internal release agent and the primary resin of the toner composition. This readily permits other materials to be dispersed in the primary resin of the toner composition without impacting the ability of the random copolymer to function as a compatibilizer of the primary resin and the wax release agent. This is particularly true if the random copolymer compatibilizer is first added to the internal release agent and the mixture of the two is added to the primary resin. For this reason it is contemplated that the present invention will function equally well to compatibilize any toner composition incorporating an internal release agent, which encompasses a wide variety of toners and developers utilized in electrophotography, including magnetic toners and compositions designed to function as one component and two component toners.

The preferred embodiment of the present invention is based upon a toner composition made from a mixture of a styrene/acrylate copolymer primary resin (or binder resin) and a polyethylene or parafin wax as an internal release agent. In the best mode of practicing the present invention, during the formulation of this toner composition an ethylene/n-butyl acrylate random copolymer is added as a compatibilizer.

To further illustrate the present invention, examples 1–5 are described in which the compatibilizing effects of a random copolymer selected as discussed above are illustrated. Observation of the size of the wax domains in the various examples was accomplished by scanning electron microscopy performed on cryogenically fractured samples of the various toner formulations.

EXAMPLE 1

With reference to example 1 of the table in FIGS. 4*a*, 4*b* and 4*c*, a toner composition was made from a thermoplastic styrene-acrylate copolymer as the primary resin, an arbitrary colorant (either magnetite, carbon black, or a mixture of the two, magnetite and carbon black being interchangable for purposes of the compatibilization study), a negative charge control additive and other additives used to impart desirable materials properties. This same composition of primary resin and additives (base toner resin) was utilized in all examples. All examples employed an internal wax release agent which was either a polypropylene or polyethylene wax. In the first example, to 100 parts (weight) of the base toner resin was added 4 parts by weight of polyethylene wax as an internal release agent to form the toner composition (see the first entry of Table 4). To this toner composition (combination of base toner resin and wax release agent) was added 2 parts by weight of a polyethylene/n-butyl acrylate random co-polymer made from 81 weight percent ethylene monomer and 19 weight percent n-butyl acrylate monomer as a compatibilizer. This compatibilizer (specifically, ENATHENE 719) had a melt index of 0.03 g/min in test conducted according to ASTM Testing Standard D1238 and number-average molecular weight of at least 40,000 g/mol. When extruded and milled the finished toner material showed maximum wax domain sizes of 3.5 microns in diameter when cryogenically fractured toner samples were observed by scanning electron microscopy.

EXAMPLE 2

With further reference to the table in FIGS. 4*a*, 4*b* and 4*c*, example 2, a second example of a toner composition was made using the same base toner resin as for example 1 and the same wax release agent in the same weight ratio (see entry 2). To this was added 3 parts by weight of a lower molecular weight version of the same random copolymer compatibilizer used in example 1 (specifically, ENATHENE 720), but having a melt index of 6.0 g/minute in test conducted according to ASTM Testing Standard D1238. This resulted in a finished toner having a maximum wax release agent domain size of 5.5 microns.

EXAMPLE 3

With reference to FIGS. 4*a*, 4*b* and 4*c*, example 3, the base toner resin was prepared as for Example 1, but into this composition was added 4 weight percent polypropylene wax as an internal release agent. This composition was compatibilized with the same high molecular weight ethylene/n-butylacrylate random copolymer employed for example 1, but using a 2.5 weight percent amount. This resulted in a finished toner composition having a maximum wax release agent domain size of 4.5 microns.

EXAMPLE 4

With further reference to FIGS. 4*a*, 4*b* and 4*c*, the entry labeled example 4, a toner composition having the same components used in example 1 was prepared, but the ratio of components was altered. Thus to 100 parts (weight) of the base toner resin was added 4 parts (weight) of polyethylene wax internal release agent and 2.5 parts (weight) of a high molecular weight 60/20/20 weight percent ethylene/ethyl acrylate-graft-polystyrene random copolymer as a compatibilizer. This resulted in a finished toner having a maximum internal release agent domain size of 2.3 microns.

EXAMPLE 5

With reference to FIGS. 4*a*, 4*b* and 4*c*, example 5, yet another toner composition was made using the same base toner resin as example 1. To 100 parts (weight) of the base toner resin was added 3 parts (weight) of polyethylene wax as an internal release agent, as for the formulation of example 1. This mixture was compatibilized with 1.5 parts (weight) of a high molecular weight ethylene/n-butylacrylate-random copolymer. This compatibilizer yielded a finished toner composition having a maximum internal release agent domain size of 2.5 microns.

With reference to FIGS. 5*a*, 5*b* and 5*c*, further examples are disclosed (examples 6–9) which utilize the same formulation of base resin and internal release agent as for example 1 of FIGS. 4*a*, 4*b* and 4*c*, but employ different compatibilizers, thus:

EXAMPLE 6

With reference to example 6 of the table in FIGS. 5*a*, 5*b* and 5*c*, added to the base toner resin and wax of example 1 of FIG. 4 (base resin, other additives and wax release agent) was 3.0 parts (weight) of a high molecular weight 30/70 weight percent ethylene/n-butyl acrylate random copolymer as a compatibilizer. The finished toner performed satisfactorily in rendering images.

EXAMPLE 7

With reference to example 7 of the table in FIGS. 5*a*, 5*b* and 5*c*, added to the base toner resin of Example 1 of FIG. 4 (base resin and other additives) was 2.5 parts (instead of 2 parts) of the same internal release agent (polyethylene wax) utilized in Example 1. To the resultant composition was added 1.0 part (weight) of a high molecular weight 60/20/20 weight percent ethylene/ethyl acrylate/styrene random copolymer as a compatibilizer. The finished toner performed satisfactorily in rendering images.

EXAMPLE 8

With reference to example 8 of the table in FIGS. 5*a*, 5*b* and 5*c*, added to the base toner resin and wax of Example 1 of FIG. 4 (base resin, other additives and wax release agent) was 3.0 parts (weight) of a high molecular weight 55/15/30 weight percent ethylene/glycidyl methacrylate/styrene random copolymer as a compatibilizer. The finished toner performed satisfactorily in rendering images.

EXAMPLE 9

With reference to example 9 of the table in FIGS. 5*a*, 5*b* and 5*c*, added to the base toner resin and wax of Example 1 of FIG. 4 (base resin, other additives and wax release agent) was added 3 parts by weight of a high molecular weight 55/15/30 weight percent ethylene/glycidyl methacrylate/styrene random copolymer as a compatibilizer. The finished toner performed satisfactorily in rendering images.

It is clear from these examples that random copolymers of both low and high molecular weight can be effective when used to compatibilize mixtures of incompatible toner constituents. It will be clear to one skilled in the art that this same scheme can be equally well utilized for primary resins based upon thermoplastic polymers selected from the group consisting of homopolymers and copolymers of styrene and substitution copolymers thereof, (meth)acrylate polymers and copolymers, vinyl polymers, polyolefins, polyurethanes, polyamides, epoxy resins and polyesters.

The above examples were produced by preblending the ingredients in an FM-40 Henschel blender. Following preblending, the contents of the Henschel blender were placed into a twin-screw extruder such as is familiar to one skilled in the art. The ingredients were melt mixed in an extruder in which the barrels were set at a temperature between about 100° C. and about 250° C. until a homogeneous mixture was obtained. The melt blended mixture was then extruded with the extrudate temperature being about 200° C. with a screw setting of 350 rpm and a material feed rate of approximately 20 pounds/hour.

The material was extruded onto a chilled roller, of a type that is familiar to those skilled in the extrusion arts, thus providing thin ribbons of material. A quantity of the material in the form of extruded ribbons was placed into a Wiley mill and fractured to give particles having a maximum particle size of 3 mm diameter.

The material thus fractured was loaded into an AFG-100 Alpine Mill jet mill and further fractured until the material had a particle median of 11.0 microns +/−0.5 micron. The mass of material thus rendered into particulate matter was classified using a LABO elbow-jet classifier.

Although the present invention has been described with reference to preferred embodiments, numerous modifications and variations can be made and still the result will come within the scope of the invention. No limitation with respect to the specific embodiments disclosed herein is intended or should be inferred.

This invention is operative with virtually any toner or developer, dry or liquid, having an organic binder or toner resin or the equivalent. Other variations in accordance with this invention will be apparent or may be developed employing this invention.

Accordingly, patent protection commensurate with this invention is sought as provided by law, with particular reference to the following claims.

It is claimed:

1. In a toner composition comprising about 100 parts of a styrene/acrylic random copolymer base resin and about 3 parts of a polyethylene wax additive, the improvement comprising:

said composition including a high number-average molecular weight random copolymer compatibilizer present in said toner composition at a level that is about 1.5 weight percent relative to the weight of said styrene/acrylic random copolymer, wherein said compatibilizer comprises 81 weight percent ethylene and 19 weight percent n-butyl acrylate monomer units.

* * * * *

UNITED STATES PATENT AND TRADEMARK OFFICE

CERTIFICATE OF CORRECTION

PATENT NO. : 6,787,279 B2
DATED : September 7, 2004
INVENTOR(S) : Bryan Patrick Livengood et al.

It is certified that error appears in the above-identified patent and that said Letters Patent is hereby corrected as shown below:

Column 8,
Line 4, replace "Random copolymers are" with -- Random copolymers lie with these two extremes. They are --.

Column 9,
Line 31, prior to "The degree" as the start of a new paragraph, with -- Random copolymers are composed of domains of their monomer components interspersed in the polymer chain. They range from the extreme of "pure" alternating copolymers to "pure blocky" copolymers. --.
Line 31, replace "resembles" with -- has segments resembling --.

Signed and Sealed this

Seventh Day of December, 2004

JON W. DUDAS
*Director of the United States Patent and Trademark Office*